United States Patent [19]

Masuda et al.

[11] Patent Number: 4,970,557

[45] Date of Patent: Nov. 13, 1990

[54] ELECTROPHOTOGRAPHIC APPARATUS CONTROLLING IMAGE QUALITY ACCORDING TO CONDITION OF DETERIORATION

[75] Inventors: Jitsuo Masuda; Hideaki Hagihara, both of Nara; Hiroshi Kinashi, Kyoto; Junji Morimoto; Ken Yamagishi, both of Nara; Teruhiko Noguchi; Itaru Kawabata, both of Osaka, all of Japan

[73] Assignee: Sharp Kabushiki Kaisha, Osaka, Japan

[21] Appl. No.: 237,868

[22] Filed: Aug. 29, 1988

[30] Foreign Application Priority Data

Sep. 2, 1987 [JP] Japan ..... 62-219701
Sep. 2, 1987 [JP] Japan ..... 62-219702
Sep. 2, 1987 [JP] Japan ..... 62-219703
Sep. 2, 1987 [JP] Japan ..... 62-219704

[51] Int. Cl.[5] ..... G03G 21/00

[52] U.S. Cl. ..... 355/246; 118/661; 355/208; 355/209; 355/251

[58] Field of Search ..... 355/246, 245, 251, 308, 355/203, 204, 209; 118/661, 656

[56] References Cited

U.S. PATENT DOCUMENTS 3,944,354 3/1976 Benwood ..... 355/245
4,261,660 4/1981 Suzuki ..... 355/203
4,462,680 7/1984 Ikeda ..... 355/246
4,521,098 6/1985 Hosoya ..... 355/245
4,533,234 8/1985 Watai ..... 355/246
4,591,261 5/1986 Saruwatari ..... 355/251
4,616,923 10/1986 Reuter ..... 355/246
4,734,737 3/1988 Koichi ..... 355/246 X
4,785,331 11/1988 Oka et al. ..... 355/246 X

FOREIGN PATENT DOCUMENTS 110474 5/1988 Japan ..... 355/246

*Primary Examiner*—A. T. Grimley
*Assistant Examiner*—Thu Dang
*Attorney, Agent, or Firm*—Flehr, Hohbach, Test, Albritton & Herbert

[57] ABSTRACT

Electrophotographic apparatus according to this invention are controlled in different ways such that quality of produced images is not affected by deterioration of the developing agent or the condition of the photoreceptor. A timer may be provided to detect the duration of a rest period to adjust the speed of development accordingly as well as by the number of copies produced. Similar control may be effected by measuring the surface voltage of the photoreceptor by a voltage detector and by adjusting the output level of the principal charger used for uniformly charging the photoreceptor prior to a development process.

10 Claims, 13 Drawing Sheets

ELECTROPHOTOGRAPHIC APPARATUS CONTROLLING IMAGE QUALITY ACCORDING TO CONDITION OF DETERIORATION

BACKGROUND OF THE INVENTION

This invention relates to electrophotographic apparatus such as copiers and photoprinters.

There are many reasons for which quality of image formed by an electrophotographic apparatus changes unreliably. With selenium-based photoreceptors, for example, it is well known that the rate of change in darkness varies, depending on the length of their rest period and that it is because the charge trapped in the photoreceptor layer is gradually released during a rest period. Such phenomena cause big changes in the image density when the electrophotographic apparatus is restarted and adversely affect the image quality. FIG. 1 shows by way of an example the change in the surface voltage of a photoreceptor comprising $As_2Se_3$ when copies are made continuously by a copier using such a photoreceptor after this copier is left unused for one hour in a ready condition. As can be seen in FIG. 1, the surface voltage is at the highest at the end of a rest period, both at dark and bright areas, dropping rapidly as soon as copying is started but stabilizing after a certain number of copies have be produced. The rate of this voltage drop varies, depending mainly on the length of the preceding rest period and also on the individual characteristics of the photoreceptor. In general, the longer the rest period, the greater is the rate of voltage drop. FIG. 2 shows the relationship between the cumulative copy count and the copy density in this situation. Since copy density is proportional to surface voltage of the photoreceptor, the curves in FIG. 2 are similar to those in FIG. 1, indicating that the density is the greatest on the first copy sheet but drops rapidly thereafter, stabilizing after a certain number of copies have been made. For example, there is a big difference in density between the first copy and the 200th copy and this means that the copy quality is not reliably uniform.

In view of the above, Japanese Patent Publication Tokko No. 60-41351, for example, disclosed a copier with the capability of controlling the charging of the photoreceptor, its exposure, the developer bias voltage and the toner supply rate according to the length of the preceding rest period in order to uniformly adjust the copy density. As explained above, however, the surface voltage which determines the copy density depends not only on the length of rest period but also on the fluctuations in the individual characteristics of the photoreceptor and other factors. Thus, uniform copy quality cannot be obtained if the copier operation is controlled only on the basis of the length of preceding rest period.

With electrophotographic apparatus using a two-component developing agent (for example, toner and a ferrite carrier) for forming a magnetic brush for its developing process, the phenomenon of so-called fogginess tends to appear when the apparatus are restarted after a rest period during which power is switched off. Because toner in the developing tank is not sufficiently charged as a whole when the apparatus is restarted, some toner particles are very weakly charged or even oppositely charged and they may come to be deposited on the surface of the photoreceptor independently of the Coulomb force and merely by mechanical contact. Toner comes to be weakly charged because of electrostatic discharge inside the developing tank during rest periods. In addition, since the apparent density of developing agent changes after it is left unused for a long time, the control sensor of the apparatus is activated when the apparatus is restarted such that an excessive amount of uncharged toner is freshly supplied into the developing tank, causing a drop in the overall level of toner charge. It now goes without saying that fogginess makes it difficult to read the hard copies made by the apparatus, or generally affects the image quality adversely.

A method of preventing fogginess in copiers and the like was suggested, for example, in Japanese Patent Publication Tokkai No. 50-46334. According to this method, the bias voltage applied for development is increased gradually from the time developing agent is replaced as the cumulative copy count increases such that the effect of deterioration of the developing agent can be compensated for. Although this method can prevent the occurrence of fogginess caused by the type of deterioration advancing slowly over a long period of time, it cannot prevent fogginess which appears when the power switch is turned on and the copier is restarted because the toner charge is actually dropped after each rest period.

Another method was disclosed in Japanese Utility Model 57-54163 for preventing adverse effects on image quality due to deterioration of developing agent. According to this method, use is made of a device for adjusting the speed of development on the basis of an output signal from a sensor for detecting toner concentration or a sensor for detecting developing capability of the developing agent. When such a sensor outputs a signal indicative of a deteriorated condition of the developing agent, however, a conventional device of this type increases the rotational speed of the magnet roller (for development) so as to decrease the speed of development. This is because, if iron particles (of $Fe_2O_3$) are used as carrier, the electroconductivity of the carrier particles drops as toner is attached to their surfaces while toner charge is increased and the image density decreases. If ferrite is used as carrier, however, the resin coating on the ferrite carrier becomes removed gradually and the electroconductivity of the ferrite carrier itself increases, causing the toner charge to drop. Thus, if such a compensating device as disclosed above is used with a copier using a developing agent having ferrite as carrier, the copy density increases instead to adversely affect the image quality.

SUMMARY OF THE INVENTION

It is therefore an object of the present invention to provide an electrophotographic apparatus with which images of constantly high quality without fogginess can be obtained.

An electrophotographic apparatus according to one embodiment of the present invention, therefore, is characterized as comprising a timer for measuring its rest period and a control means for controlling its speed of development to make it slower step-wise as its rest period becomes longer and to become faster step-wise as its cumulative copy count increases. As explained above, the surface voltage of a photoreceptor increases as its rest period becomes longer but decreases rapidly thereafter as soon as the use of the photoreceptor is restarted, stabilizing after a certain number of copies has been made. The rate of this drop in surface voltage depends on the length of the preceding rest period as shown in FIG. 1. The characteristic shown in FIG. 1 is more or less commonly shared among all photoreceptors which are similarly structured such that the change in surface voltage is substantially predictable if the copier's cumulative copy count is known. Thus, as soon as the photoreceptor is restarted after a rest period, the timer is consulted to determine, for example, whether the preceding rest period was less than one minute, one minute or over but less than two minutes, two minutes or over but less than five minutes, five minutes or over but less than 11 minutes, 11 minutes or over but less than 24 minutes, 24 minutes or over but less than 54 minutes, 54 minutes or over but less than 120 minutes or 120 minutes or over. The control means sets the initial speed of development, depending on to which of the aforementioned eight steps the preceding rest period belongs. After copying is restarted and the copy count increases, the control means varies the speed of development depending, for example, on whether the copy count since the restart is less than 5, 6 or over but less than 15, 16 or over but less than 30, 31 or over but less than 60, 61 or over but less than 100, 101 or over but less than 180, 181 or over but less than 320, or 321 or over. In summary, the speed of development is controlled by a speed table of a kind shown in Table 1 where $V_1 > V_1 > \ldots > V_7$. In other words, while the copy count is still small after copying is restarted, the surface voltage is high and the speed of development is made small. By the speed of development is meant the relative speed of the surface of the photoreceptor with respect to toner in the developing device which brushes against it. In the case of a copier using a magnet roller in its developing device, for example, the relative speed of the photoreceptor surface with respect to the peripheral surface of the magnet roller indicates the speed of development. An exemplary relationship between the speed of development and the image density is shown in FIG. 3. After the cumulative copy count increases, the surface voltage of the photoreceptor drops gradually, reducing the image density. This is compensated according to the present invention by increasing the speed of development according to a schedule as shown in Table 1. In summary, electrophotographic apparatus according to this embodiment of the present invention vary the speed of development in a step-wise manner not only depending on the length of the preceding rest period before the restart but also depending on the number of copies made since the restart such that the density of copy image is uniformly controlled.

TABLE 1

| Time of Rest (min) | Number of Copies 0–5 $C_1$ | 6–15 $C_2$ | 16–30 $C_3$ | 31–60 $C_4$ | 61–100 $C_5$ | 101–180 $C_6$ | 181–320 $C_7$ | 321– $C_8$ |
|---|---|---|---|---|---|---|---|---|
| $T_1$: 0–1 | $V_0$ | $V_0$ | $V_0$ | $V_0$ | $V_0$ | $V_0$ | $V_0$ | $V_0$ |
| $T_2$: 1–2 | $V_1$ | $V_0$ | $V_0$ | $V_0$ | $V_0$ | $V_0$ | $V_0$ | $V_0$ |
| $T_3$: 2–5 | $V_2$ | $V_1$ | $V_0$ | $V_0$ | $V_0$ | $V_0$ | $V_0$ | $V_0$ |
| $T_4$: 5–11 | $V_3$ | $V_2$ | $V_1$ | $V_0$ | $V_0$ | $V_0$ | $V_0$ | $V_0$ |
| $T_5$: 11–24 | $V_4$ | $V_3$ | $V_2$ | $V_1$ | $V_0$ | $V_0$ | $V_0$ | $V_0$ |
| $T_6$: 24–54 | $V_5$ | $V_4$ | $V_3$ | $V_2$ | $V_1$ | $V_0$ | $V_0$ | $V_0$ |
| $T_7$: 54–120 | $V_6$ | $V_5$ | $V_4$ | $V_3$ | $V_2$ | $V_1$ | $V_0$ | $V_0$ |
| $T_8$: 120– | $V_7$ | $V_6$ | $V_5$ | $V_4$ | $V_3$ | $V_2$ | $V_1$ | $V_0$ |

Another electrophotographic apparatus according to a second embodiment of the present invention is characterized as comprising a voltage detector for detecting the surface voltage of its photoreceptor and a control means for controlling the speed of development according to the detected surface voltage such that the speed of development is reduced if the detected surface voltage is higher. As is well known, the photoreceptor is uniformly charged by a charger before it is exposed to light and the surface voltage of the photoreceptor is detected by the voltage detector before development takes place. If the voltage detector is disposed opposite to a part of the photoreceptor before it is exposed, it can detect the surface voltage of a dark region. If it is disposed opposite to the position exposed to a blanking lamp, it can detect the surface voltage of a bright region. If a region to be exposed according to a pattern is preliminarily determined, the voltage detector may be disposed so as to detect the surface voltage at such region. The voltage detector detects a highest surface voltage at the end of a rest period and, as explained above, the detected surface voltage drops rapidly as soon as the use of the apparatus is restarted, stabilizing after a certain degree of use. Thus, the control means in this case controls the speed of development such that it becomes slower if the detected surface voltage is high.

Still another electrophotographic apparatus according to a third embodiment of the present invention is characterized not only as using a two-component developing agent to form a magnetic brush for development but also as comprising a control means which causes a stirrer roller in the developing device to rotate faster during a predetermined period of time after power is switched on and before development is started than during the time of development. The toner charge which becomes reduced during a rest period can be increased again by stirring as shown in FIG. 4 wherein the change is indicated by a broken line when the stirrer roller is rotated at the normal rate $v_L$ during development and by a solid line when the stirrer roller is rotated at an increased rate $v_H$. It is clear that recovery is more quickly achieved if the stirrer roller is moved faster. If the control unit causes the stirrer roller to rotate faster for a predetermined period of time, therefore, the toner charge can be quickly recovered to the normal level such that occurrence of fogginess can be prevented. The aforementioned predetermined period of time during which the stirrer roller is rotated at a faster rate may be after the power switch is turned on and before the fixer reaches its normal temperature and becomes operable or after the start key is pressed and before development on the photoreceptor is actually started. Although it may be suggested that the stirrer roller be rotated at a faster rate all the time, it should be remembered that the stirrer roller is usually rotated in synchronism with the magnet roller for development such that the speed of development would also be increased if the stirrer roller were accelerated. Moreover, if the stirrer roller were rotated at a faster rate all the time, this would accelerate the deterioration of the developing agent. The present invention, therefore, teaches increasing the rotational speed of the stirrer roller only during a starting time during which the toner charge recovers to its normal level.

Still another electrophotographic apparatus according to a fourth embodiment of the present invention is characterized not only as using a two-component developing agent with ferrite carrier to form a magnetic brush for development but also as comprising a counter for recording the cumulative copy count of its developing device and a control device for reducing the speed of development by the developing device as the recorded count increases and/or the output of the charger for charging the photoreceptor. As shown in FIG. 5, the surface voltage of a photoreceptor drops as the output level of the principal charger is reduced. As explained above and generally known, two-component developing agent with ferrite carrier becomes deteriorated with use and the image density tends to become large with such deterioration. FIG. 6 shows this phenomenon in the case of a copier using ferrite carrier. Thus, if a counter is used to count the number of copies made by the copier, the level of deterioration of the developing agent can be detected. Such a counter is reset when deteriorated developing agent is replaced by a fresh supply and is adapted to continue counting independently of whether the main power switch of the copier is on or off until the developing agent is replaced again. If the speed of development is reduced with the other conditions remaining the same, the adsorptive force on toner at the photoreceptor surface is also reduced and the image becomes lighter. Thus, the effect of carrier deterioration can be compensated for if the speed of development and/or output of the principal charger is reduced accordingly.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION OF PREFERRED EMBODIMENTS

Figure 7:
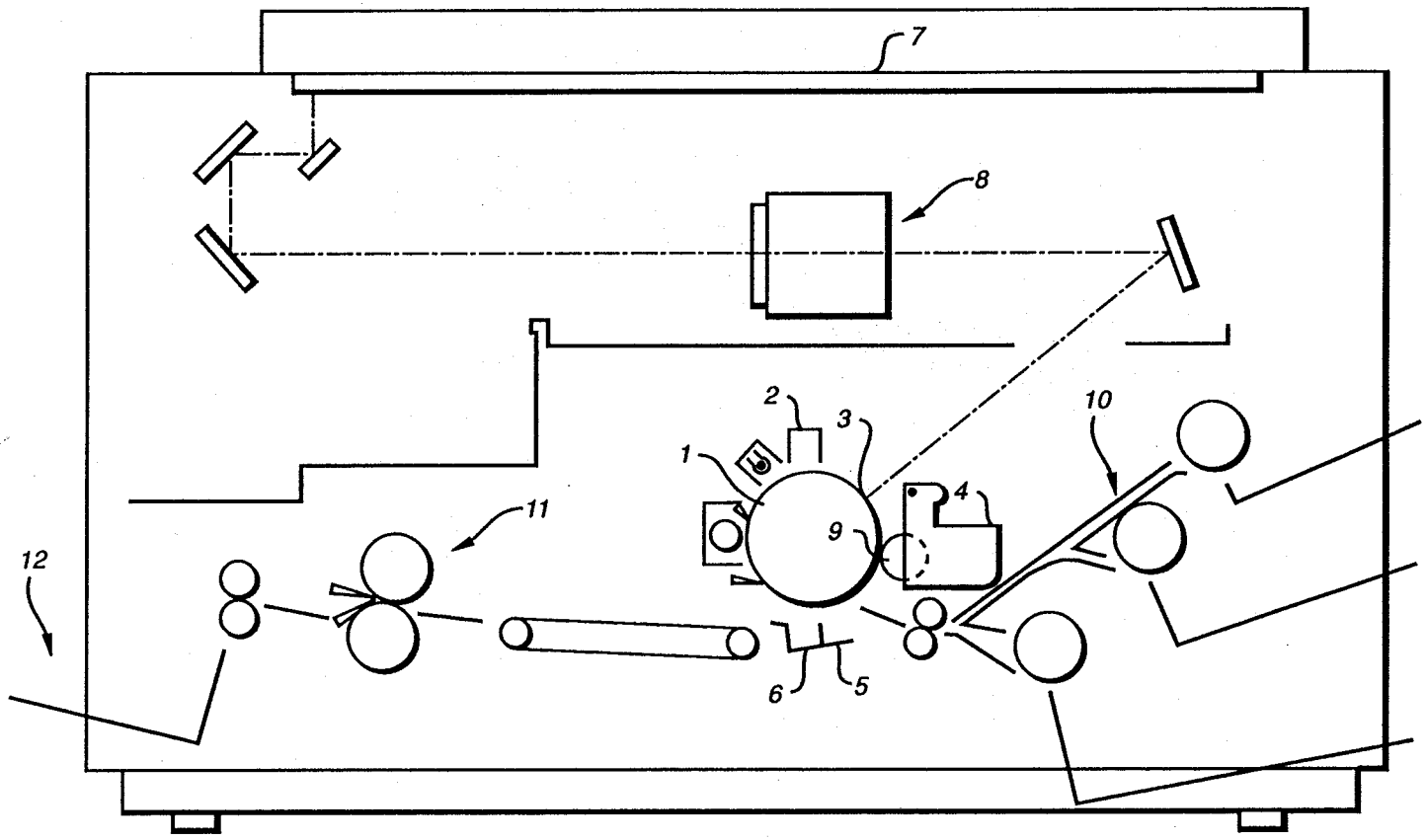
FIG. 7 is a schematic frontal sectional view of an electrophotographic copier embodying the present invention.

FIG. 7 shows an electrophotographic copier embodying the present invention having nearly at its center a photoreceptor drum 1 with a photosensitive layer around an aluminum drum. The photoreceptor drum 1 is rotatably supported and is rotated by a driving mechanism (not shown). Disposed around the photoreceptor drum are a principal charger 2, an exposure region 3, a developing device 4, a transfer charger 5, and a paper removing charger 6 in this order. All these components are well known by a person skilled in the electrophotography art and constitute what may be referred to as a copying section.

The principal charger 2 is for uniformly charging the surface of the photoreceptor drum 1. The exposure region is the region where reflected light from an original document to be copied and placed on a document table 7 is made incident by means of an optical system 8. A latent image is formed on the surface of the photoreceptor drum 1 by this incident light. The developing device 4 is for applying toner onto the latent image formed on the surface of the photoreceptor drum 1 to develop a visible toner image. The developing device 4 includes a magnet roller 9 and a stirrer roller 14 and toner adsorbed on the surface of the magnet roller 9 is brushed against the surface of the photoreceptor drum 1. The magnet roller 9 is rotated controllably by a DC servo motor to be explained more in detail below. The DC servo motor not only rotates the magnet roller 9 but also controls the relative speed of its surface which brushes against the surface of the photoreceptor drum 1. The transfer charger 5 is a charger for transferring the toner image on the surface of the photoreceptor drum 1 onto a transfer sheet of paper. The paper removing charger 6 is a charger which makes it easier for the transfer sheet to be peeled off from the surface of the photoreceptor drum 1. The transfer sheet is fed from a paper feeding section 10, passed between the photoreceptor drum 1 and the transfer charger 5 and the paper removing charger 6, fixed by a fixing device 11 and discharged onto a discharge tray 12. Numeral 15 in FIG. 7 indicates a paper detector disposed at a forward position of the paper feeding section 10 for detecting a transfer sheet being fed.

Figure 8:
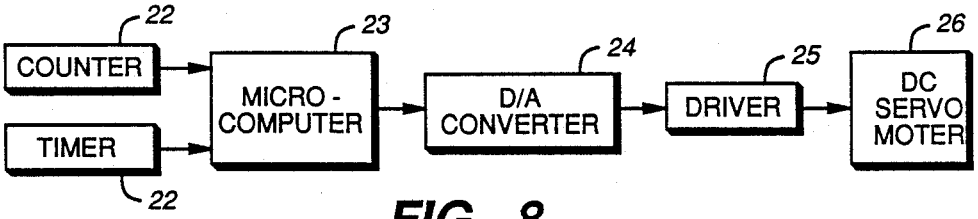
FIG. 8 is a block diagram of the control section for the copier of FIG. 8.

The control section of the copier explained above is characterized as shown in FIG. 8 as having a timer 21 and a copy sheet counter 22 connected to a microcomputer 23 for receiving digital output signals from the timer 21 and the counter 22. The microcomputer 23 is connected through a digital-to-analog converter 24 to a driver 25 for controlling the motion of a DC servo motor 26 connected to the magnet roller 9 of the developing device 4. The timer 21 is for measuring the length of time from the moment the copier was switched off previously until the present and as soon as the copier is restarted, its counted time length representing the length of the preceding rest period is outputted as a digital signal to the microcomputer 23. The microcomputer 23 stores a table as shown in Table 1 explained above. If the preceding rest period was 20 minutes, for example, the microcomputer 23 chooses the corresponding time period denoted by $T_5$ in Table 1 and initially selects the entry $V_4$ in this time period corresponding to the group $C_1$ representing the copy counts in the range of 0–5, outputting a digital signal indicative of the value of $V_4$. This output signal is converted into an analog signal by the digital-to-analog converter 24 and then received by the driver 25 which responds to this signal by controllingly driving the DC servo motor 26 at the speed of development given by $V_4$ until the copy count reaches 5.

Figure 1:
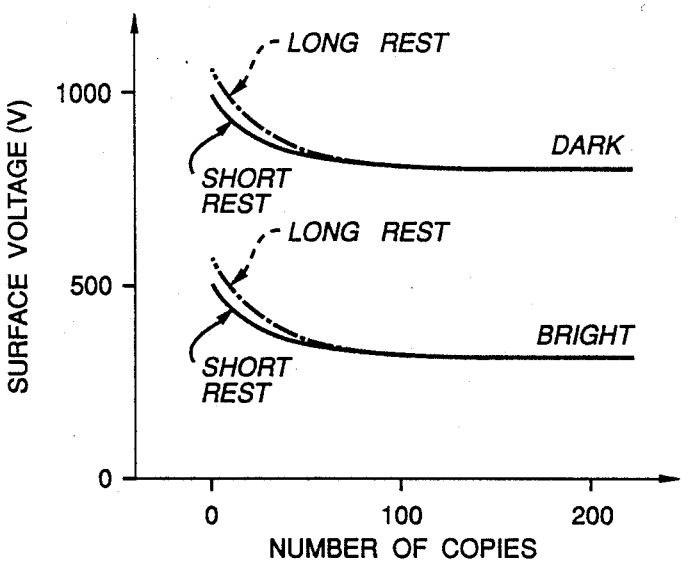
FIG. 1 (PRIOR ART)
FIG. 1 is a graph showing the relationship between cumulative copy count and surface voltage of a photoreceptor of a prior art copier.
Figure 2:
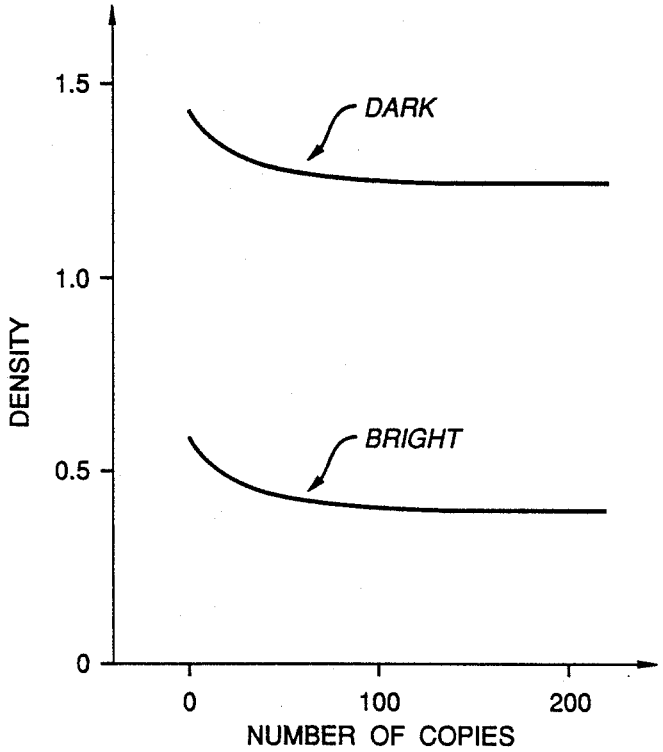
FIG. 2 (PRIOR ART)
FIG. 2 is a graph showing the relationship between cumulative copy count and copy density obtained by a prior art copier.
Figure 9:
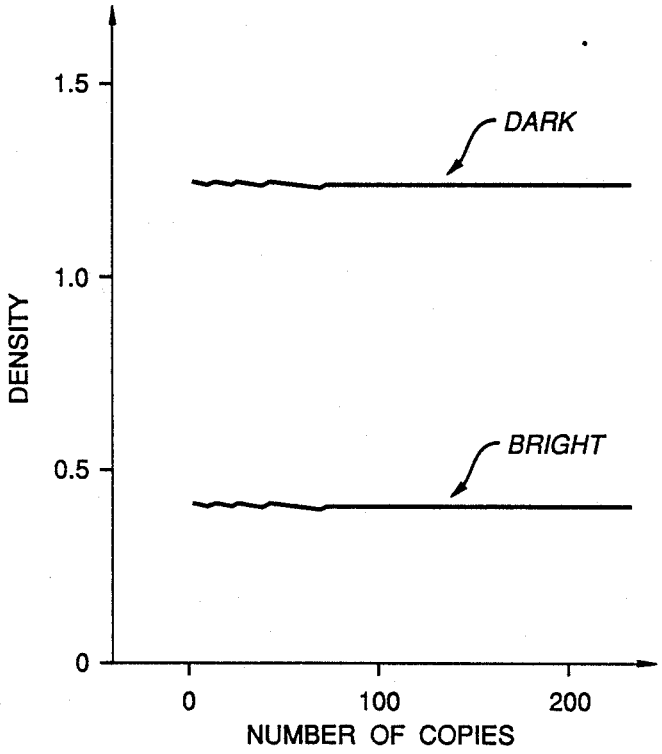
FIG. 9 is a graph showing the relationship between cumulative copy count and copy density by a copier structured as shown in FIGS. 7 and 8.

When the copy sheet count counted by the counter 22 reaches 5, the microcomputer 23 outputs another signal indicative of the value $V_3$ selected from the same time period $T_5$ with reference to Table 1 but corresponding to the group $C_2$ representing the copy counts in the next range of 6–15. This new signal is similarly transmitted to the driver 25 and the magnet roller 9 is thereafter rotated at the new speed of development until the copy sheet count reaches 15, and so forth. In summary, the speed of development, or the rotational speed of the magnet roller 9 by the DC servo motor 26 is increased in a step-wise manner. If the copy sheet counts exceeds 61, the DC servo motor 26 rotates the magnet roller 9 at the speed of $V_0$. By this time, the surface voltage of the photoreceptor drum 1 is stabilized and copying is thereafter effected at this speed of development. FIG. 9 shows the measured copy density on copies obtained under the same conditions as for FIG. 2 but by using a copier structured as explained above. FIG. 9, in contrast to FIG. 2, clearly shows that the present invention succeeds in uniformizing copy density independently of the number of copies produced.

Figure 11:
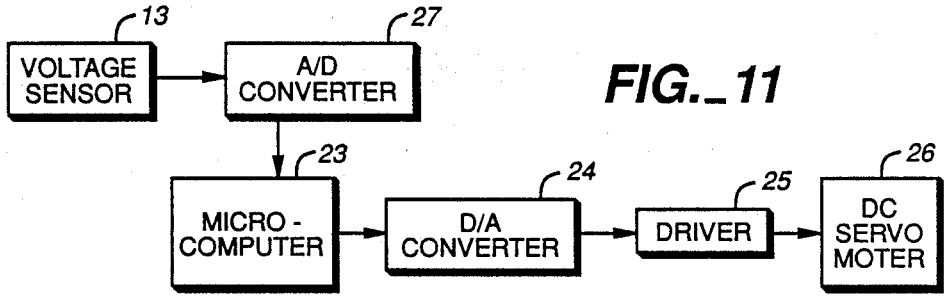
FIG. 11 is a block diagram of the control section for the copier of FIG. 10.
Figure 10:
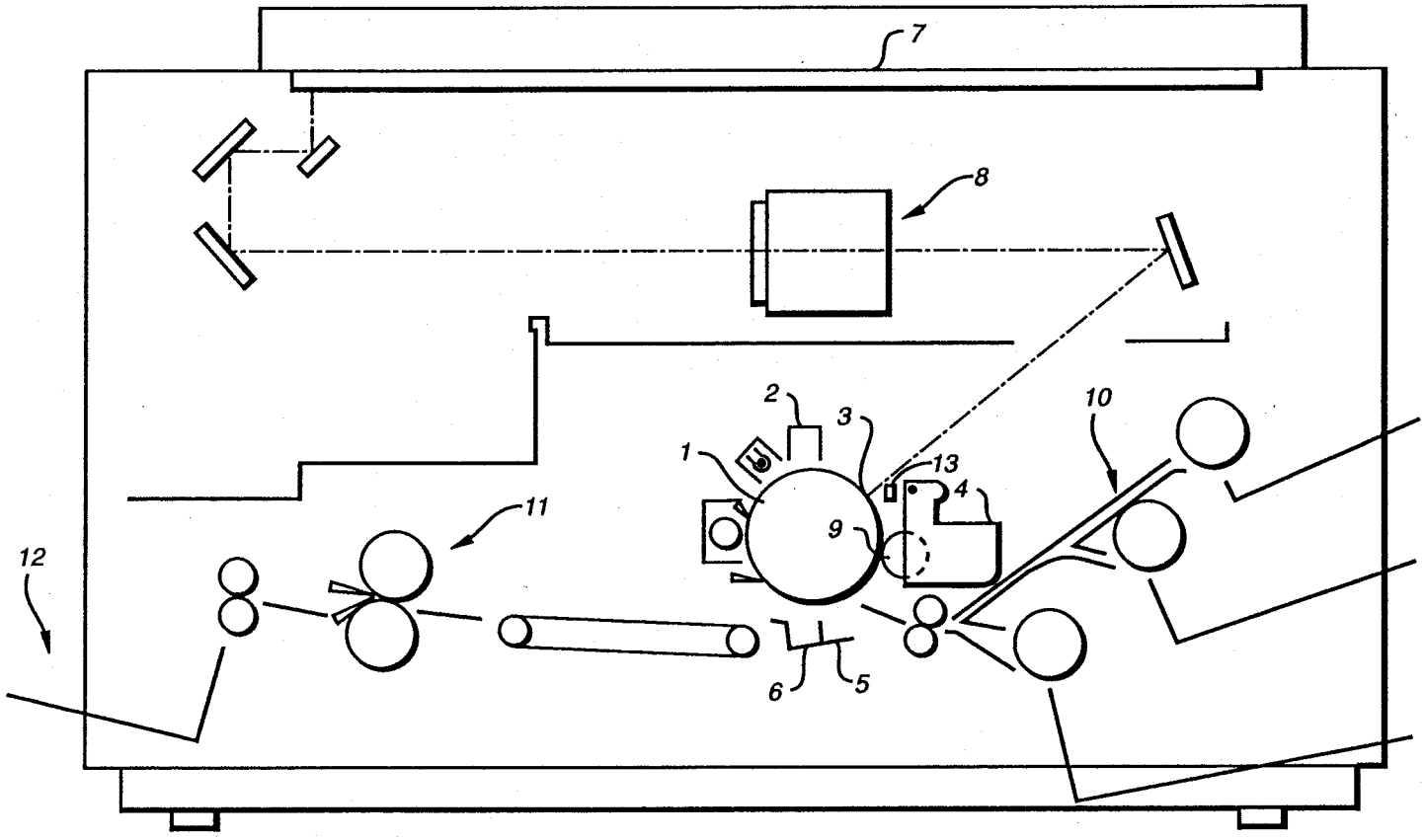
FIG. 10 is a schematic frontal sectional view of another electrophotographic copier embodying the present invention.
Figure 12:
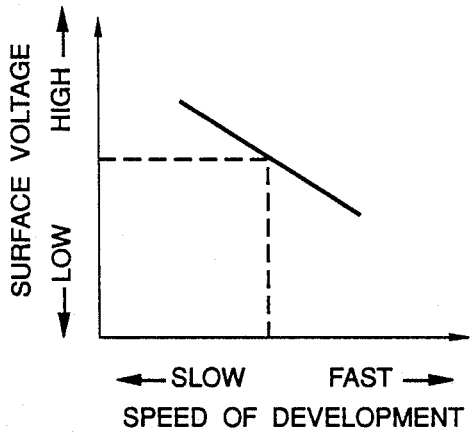
FIG. 12 is a graph showing the relationship between surface voltage of the photoreceptor and speed of development stored in and used by the microcomputer shown in FIG. 11.

FIG. 10 shows another electrophotographic copier according to the aforementioned second embodiment of the present invention which is structured similarly to the copier explained above by way of FIG. 7 but is characterized as also comprising a voltage sensor 13 which is adapted to detect the surface voltage of the photoreceptor drum 1 and is disposed between the exposure region 3 and the developing device 4. As shown in FIG. 11 which is a block diagram of the control section of this copier shown in FIG. 10, an analog signal outputted from this voltage sensor 13 indicative of the surface voltage of the photoreceptor drum 1 is converted into a digital signal by an analog-to-digital converter 27 and received by the microcomputer 23. The microcomputer 23 of this copier is characterized as storing as a program the relationship between the surface voltage of the photoreceptor 1 and the speed of development as shown in FIG. 12 which indicates that the speed of development should generally be reduced when the surface voltage is high and hence the copy density tends to be high. On the basis of this relationship expressed as an equation, the microcomputer 23 calculates and determines a speed of development corresponding to the surface voltage indicated by the received signal. The speed of development thus 23 is converted into an analog signal by a digital-to-analog converter 24 and received by a driver 25 which controllingly drives a DC servo motor 26 connected to the stirrer roller 14.

Figure 14:
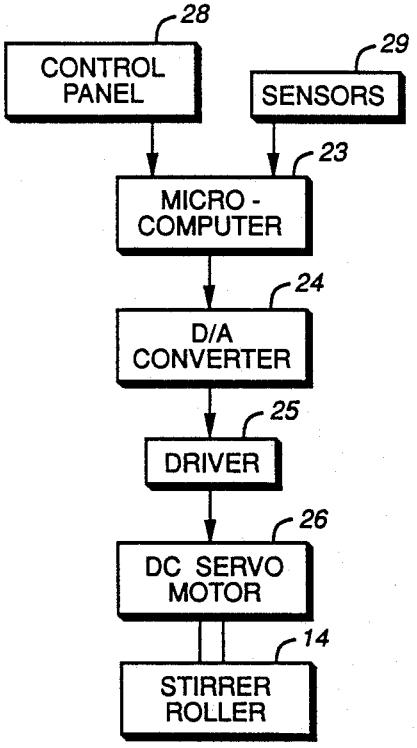
FIG. 14 is a block diagram of the control section of still another copier embodying the present invention.
Figure 15:
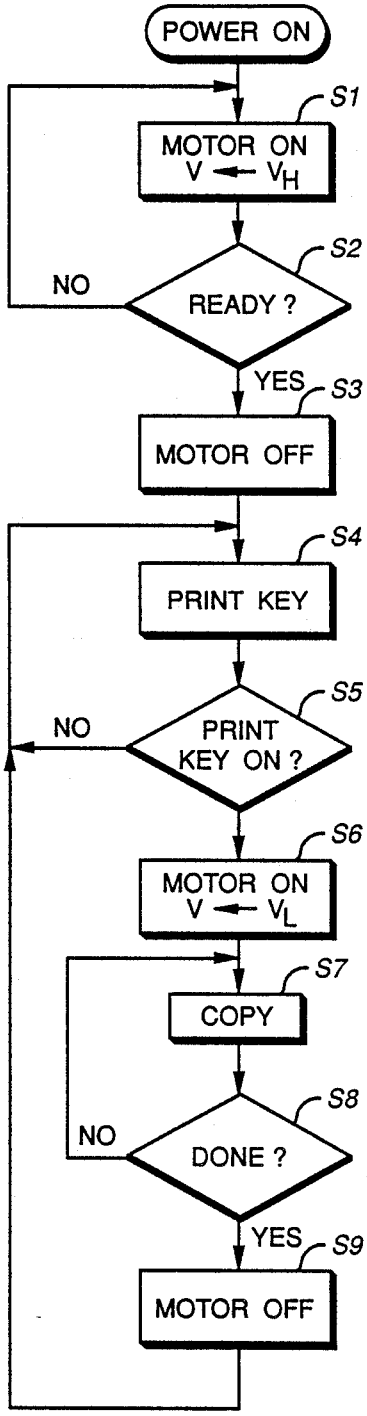
FIG. 15 is a flow chart of the operation of the copier shown in FIG. 14.

The microcomputer 23 of the copier according to this embodiment of the present invention is so programmed as shown in FIG. 15 that when the power switch for the copier is turned on, the servo motor 26 is immediately started to rotate at a fast rate $v_H$ (S1). At the same time, the microcomputer 23 starts heating up the heat roller of the fixing device 11. The temperature sensor (one among those at 29 in FIG. 14) keeps monitoring the temperature of the heat roller and as long as the heat roller is not warm enough to be used for fixing (NO in S2), the stirrer roller 14 is rotated at this higher rate $V_H$, quickly recovering the toner charge level. When the temperature sensor detects that the heat roller is ready to be used (YES in S2), the servo motor 26 is stopped (S3) and the copier waits for its print key to be pressed (S4). When the print key is pressed for starting a regular copying operation (YES in S5), the servo motor 26 is rotated at a slower rate $v_L$ (S6) for the normal developing operation (S7). When a desired number of copies has been produced (YES in S8), the servo motor 26 is stopped (S9) and the copier waits for its print key to be pressed again for the next cycle of copying operation.

Figure 16:
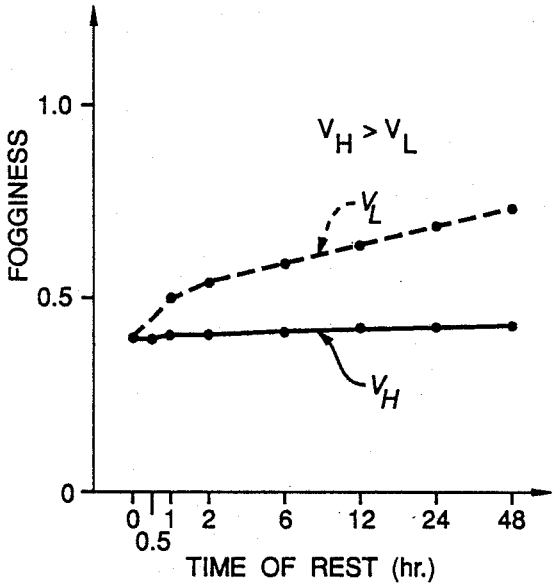
FIG. 16 is a graph showing the relationship between fogginess appearing on the first copy and the length of the rest period before the copying.

FIG. 16 shows the relationship between the amount of fogginess which appears in the first copy produced after a rest period and the length of this rest period. The solid line indicates the situation where the stirrer roller 14 is caused to rotate at a faster rate as explained above. The broken line indicates the situation where the stirrer roller 14 is rotated at its usual slower rate set for development operation. FIG. 16 clearly shows that the effect of long rest periods on the appearance of fogginess is well compensated for by the present invention.

Figure 17:
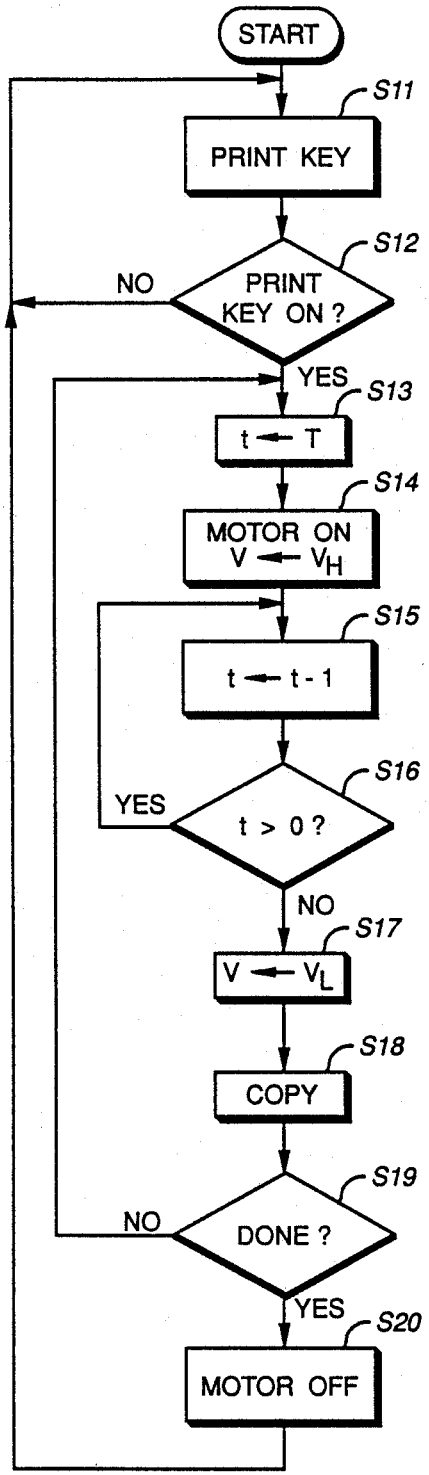
FIG. 17 is a flow chart for showing another way of programming the operation of the copier shown in FIG. 14.
Figure 18:
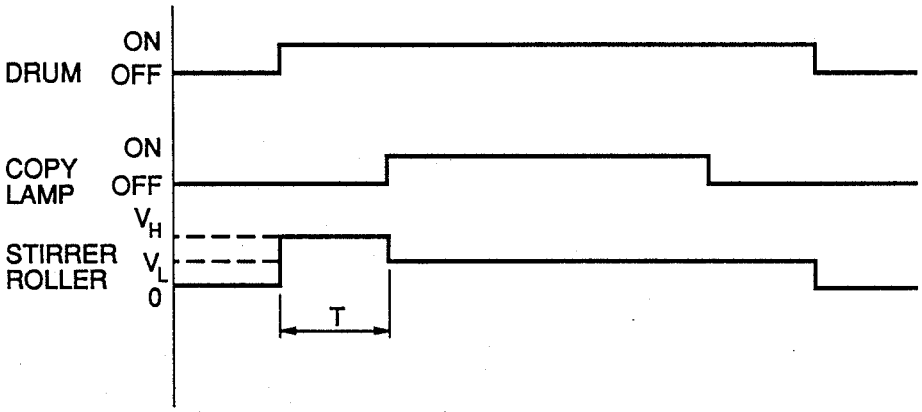
FIG. 18 is a time chart for the operation according to the program shown in FIG. 17.

The program shown by the flow chart in FIG. 15 is not intended to limit the scope of the present invention regarding the microcomputer 23 of FIG. 14. FIG. 17 shows another program according to which the microcomputer 23 of FIG. 14 may be controlled. This program is different from the one described above in that the stirrer roller 14 is rotated at a faster rate only after the print key is actually pressed (S11 and YES in S12). As soon as the print key is pressed, a predefined time period T is set in a timer (S13) and the servo motor 26 begins to rotate at the fast rate $v_H$ (S14). The timer is of the common type and keeps decrementing its setting (S15) until its set value becomes 0 (YES in S16). After the servo motor 26 has rotated at this fast rate $v_H$ for the predefined time period T, the speed of the servo motor 26 is reduced to its normal lower rate $v_L$ for development operation (S17). When the servo motor 26 is initially started at a faster rate, rotation of the photoreceptor drum 1 is also started simultaneously as shown in FIG. 18. When the timer counts up the set time and the speed of the servo motor 26 is reduced as explained above, the copy lamp of the optical system 8 is turned on to prepare for a cycle of copying operation (S18). After a desired number of copies has been produced (YES in S19), the servo motor 26 is stopped and the photoreceptor drum 1 is stopped. The copy lamp is already turned off by this time as shown in FIG. 18.

Figure 19:
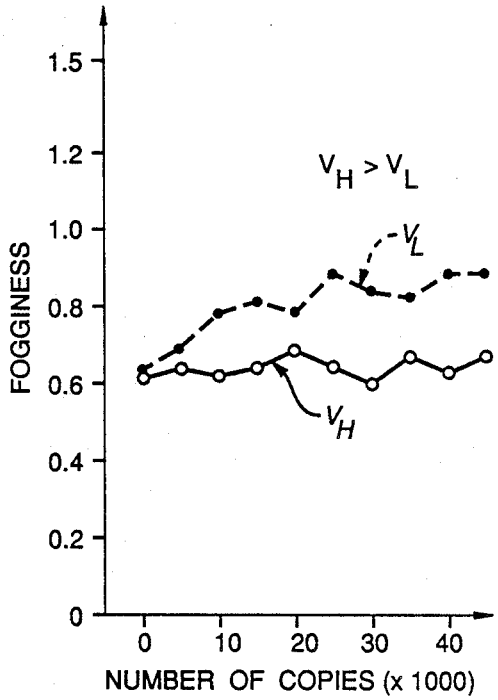
FIG. 19 is a graph showing the relationship between fogginess appearing on the first copy and the length of the rest period before the copying.

The relationship between the amount of fogginess that appears on the first copy after a rest period and the length of this rest period in this case of the copier described above was similar to that shown in FIG. 16. FIG. 19 shows for the case of this copier the relationship between the amount of fogginess and the number of produced copies. The solid line again indicates the situation where the servo motor 26 was rotated at a faster rate $v_H$ and the broken line indicates the situation where the servo motor 26 was rotated at its normal lower rate $v_L$ for development operation. FIG. 19 also shows clearly that the amount of fogginess can be prevented from increasing independently of the number of copies that are produced.

Figure 13:
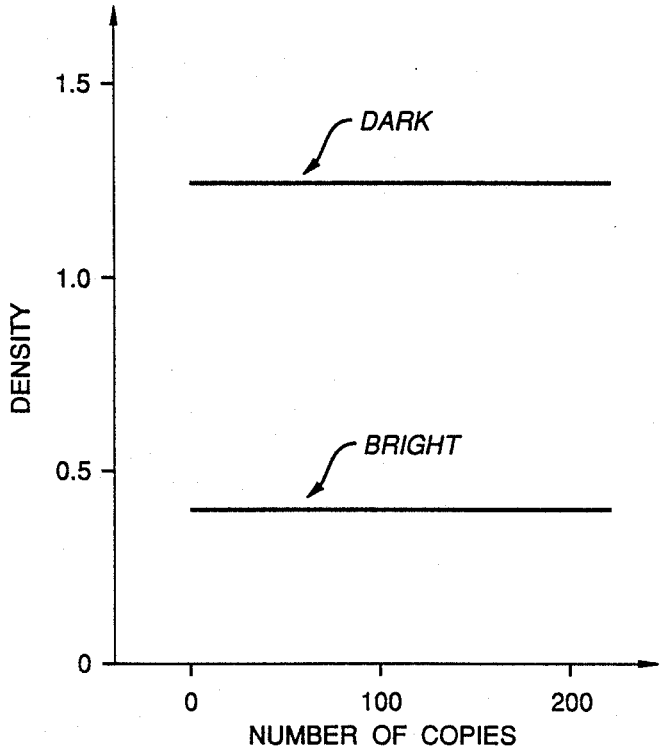
FIG. 13 is a graph showing the relationship between cumulative copy count and copy density by a copier structured as shown in FIGS. 10 and 11.
Figure 20:
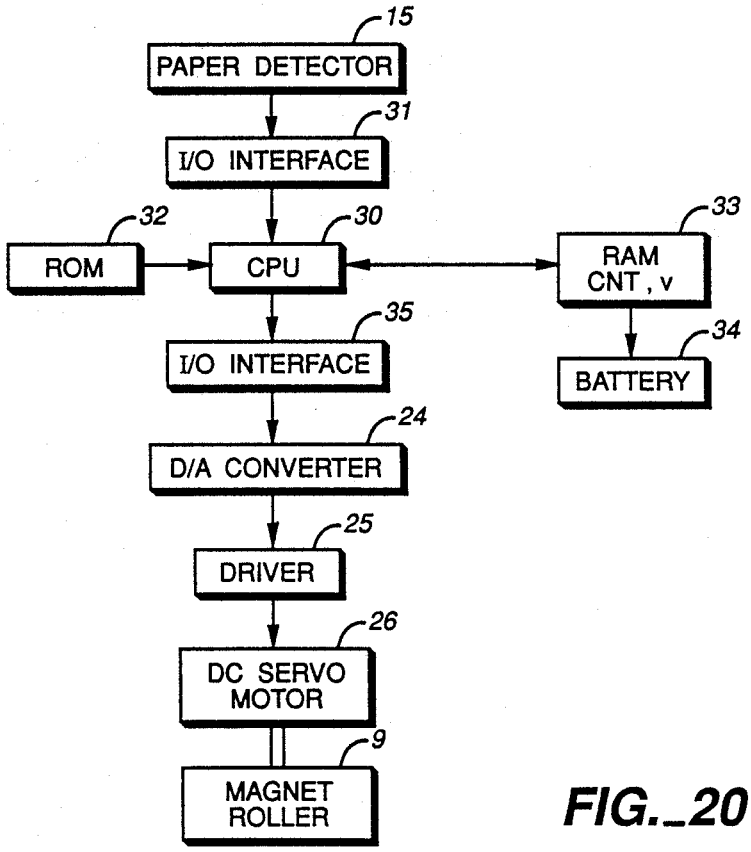
FIG. 20 is a block diagram of the control section of still another copier embodying the present invention.

Still another electrophotographic copier according to the aforementioned fourth embodiment of the present invention structured as shown in FIG. 7 has a control section which is characterized as shown in FIG. 20 wherein the signal outputted from the paper detector 15 is received by a central processing unit CPU 30 through an I/O interface circuit 31. The CPU 30 follows a program stored in a read-only memory ROM 32 and calculates the cumulative copy count on the basis of signals thus received from the paper detector 15, storing the calculated copy count at a memory area CNT inside a random-access memory RAM 33 backed up by a battery 34. The CPU 30 is also adapted to follow another program stored in the ROM 32 to read the copy count stored at CNT of the RAM 33, determines a speed of development corresponding to this copy count and stores this speed value at another memory area v. Because the RAM 33 is backed by the battery 34, the values stored at the areas CNT and v of the RAM 33 are not lost even if the main determined is converted into an analog signal by the digital-to-analog converter 24 and transmitted to the driver 25. FIG. 13 shows the measured copy density on copies obtained under the same conditions as for FIG. 2 but by using a copier thus structured according to the second embodiment of the present invention. A comparison between FIGS. 13 and 2 clearly shows that a copier according to this embodiment of the present invention also succeeds in uniformizing copy density independently of the number of copies produced. To summarize, a copier according to this embodiment of the present invention not only detects the length of preceding rest period but also directly measures the surface voltage of the photoreceptor. Thus, an optimum control can be effected without being affected by individual fluctuations in the characteristics of photoreceptors or other factors and even after the photoreceptor is replaced by a new one.

Still another electrophotographic copier according to the aforementioned third embodiment of the present invention is structurally as shown in FIG. 7. Its control section, which is schematically shown in FIG. 14, is characterized wherein its microcomputer 23 serves not only to generally control the ordinary copying cycles of copier operation but also to determine the rotational speed v of the stirrer roller 14 of the developing device 4 and to output a digital signal indicative of this determined value v. The rotational speed v of the stirrer roller 14 is determined on the basis of data received from various sensors 29 inclusive of a temperature sensor for the heat roller of the fixing device 11. In FIG. 14, numeral 28 indicates a control panel with input keys. The digital signal outputted from the microcomputer power for the copier is switched off. The CPU 30 also follows still another program stored in the ROM 32 to read out the value stored in the area v, transporting it to another I/O interface circuit 35 for latching. The contents of v latched by the I/O interface circuit 35 are converted by the digital-to-analog converter 24 and transmitted to the driver 25 for controlling the DC servo motor 26 for the magnet roller 9 of the developing device 4. In other words, the DC servo motor 26 and the magnet roller 9 are rotated at a speed v corresponding to the contents of the memory area v.

Figure 21:
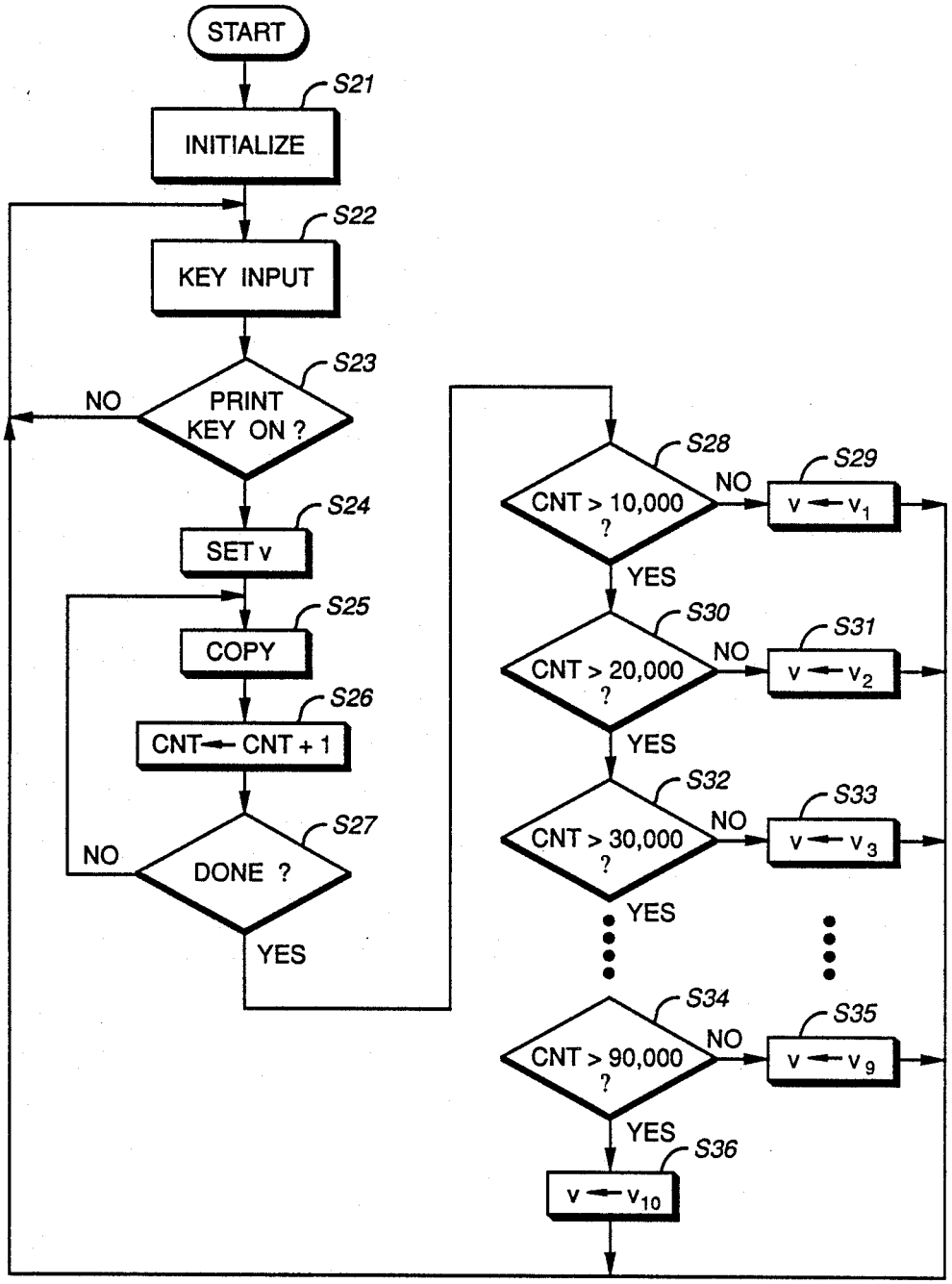
FIG. 21 is a flow chart for the operation of the copier shown in FIG. 20.

After the main power switch of the copier shown in FIG. 20 is turned on, various initialization processes of a known type are effected (S21) as shown in the flow chart of FIG. 21, and copying conditions such as magnification and number of copies are received through key input (S22). When the print switch is finally pressed (YES in S23), the content of the memory area v which, like the content of the area CNT, is independent of the aforementioned initialization process and is already stored is retrieved and the speed of development v is set (S24). During each copying cycle (S25), the paper detector 15 detects a copy sheet passing thereby and transmits a detection signal to the CPU 30 which responds by adding 1 to the content of the memory area CNT (S26). When the desired number of copies has been produced (YES in S27), the copying cycle is no longer repeated. A separate counter of a conventional type different from the one at the memory area CNT is used for determining whether the desired number of copies has been produced.

When the copying is completed, the content of the memory area CNT indicating the cumulative copy count is retrieved and compared with 10,000 (S28). If the cumulative copy count is less than 10,000, a predetermined speed of development $v_1$ is stored in the memory area v (S29). If the cumulative copy count is between 10,000 and 20,000 (NO in S30), another value $v_2$ smaller than $v_1$ is set (S31). If the cumulative copy count is between 20,000 and 30,000 (NO in S32), still another value $v_3$ smaller than $v_2$ is set (S33). In a similar manner, yet small values $v_4 \ldots v_{10}$ are set, depending on to which of the subsequent 10,000-sheet ranges the cumulative copy count belongs. If the cumulative copy count exceeds 100,000, a new supply of developing agent is introduced and the content of the memory area CNT is simultaneously reset to 0. After the content of the memory area v is thus set, the copier waits for the print switch to be pressed again.

Figure 3:
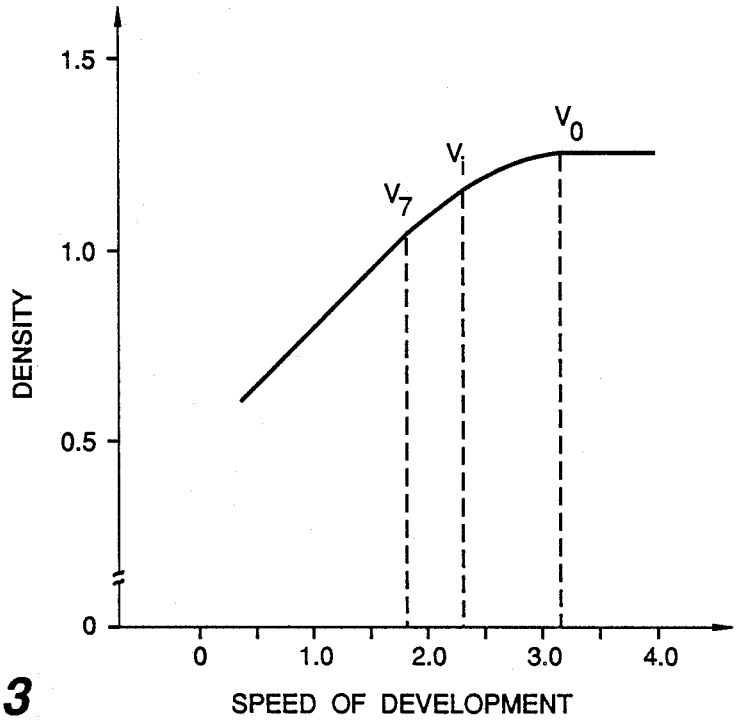
FIG. 3 is a graph showing the relationship between speed of development by a developing device and copy density.
Figure 4:
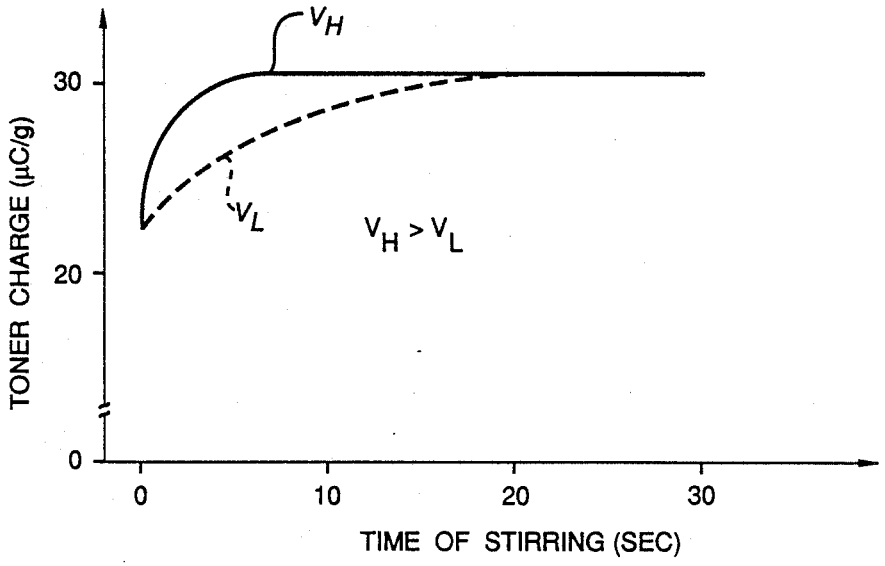
FIG. 4 is a graph showing the recovery in toner charge when a developing agent is stirred after a rest period.
Figure 22:
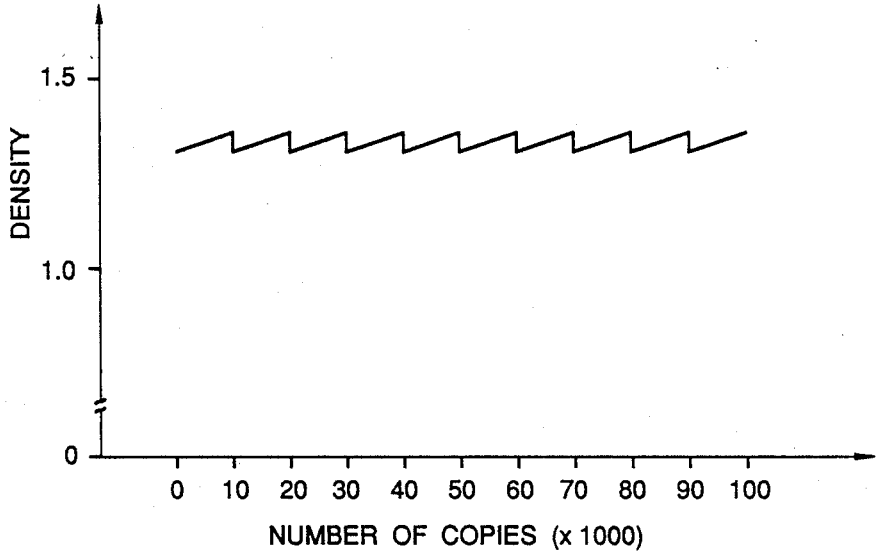
FIG. 22 is a graph showing the relationship between the copy density and the cumulative copy count by the copier shown in FIG. 21.

As shown in FIG. 3, the slower the speed of development, the lower becomes the copy density. Thus, if the speed of development is reduced step-wise as the cumulative copy count increases, the effect of deterioration of the developing agent whereby image density tends to increase can be compensated. FIG. 22 shows the relationship between the copy density and the cumulative copy count regarding the copier shown above. Because the speed of development is reduced every time 10,000 copies are produced, the tendency of the curve to rise is blocked after every 10,000 copies such that the copy density is uniformly controlled.

Figure 23:
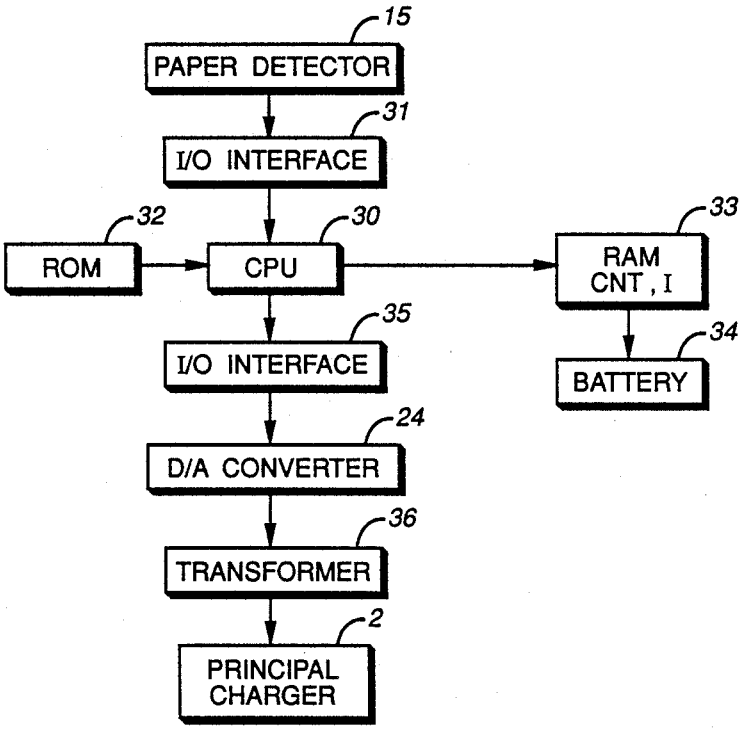
FIG. 23 is a block diagram of another control section for a copier structured as shown in FIG. 7.

The block diagram of FIG. 20 and the flow chart of FIG. 21 are not intended to limit the scope of the present invention. The control section of a copier structured as shown in FIG. 7 may alternatively be so structured as shown in FIG. 23 that deterioration of developing agent is compensated by controlling the output of its principal charger 2. Thus, the CPU 30 is adapted to follow still another program stored in the ROM 32 and, after retrieving the cumulative copy count stored in the memory area CNT in the RAM 33, determines according to this program an output level of the principal charger 2 corresponding to the current CNT value and stores this determined output level at another memory area I in the RAM 33. Since the RAM 33 is backed by a battery 34, neither is this level value stored at the memory area I lost when the main power source for the copier is switched off. Thereafter, the CPU 30 retrieves the value I stored in the memory area I according to still another program stored in the ROM 32 and transmits it to the I/O interface circuit 35 for latching. The content of the memory area I thus latched at the I/O interface circuit 35 is converted into an analog signal by the digital-to-analog converter 24 and transmitted to a principal charger transformer 36 which serves to output to the principal charger 2 a voltage corresponding to the received signal.

Figure 24:
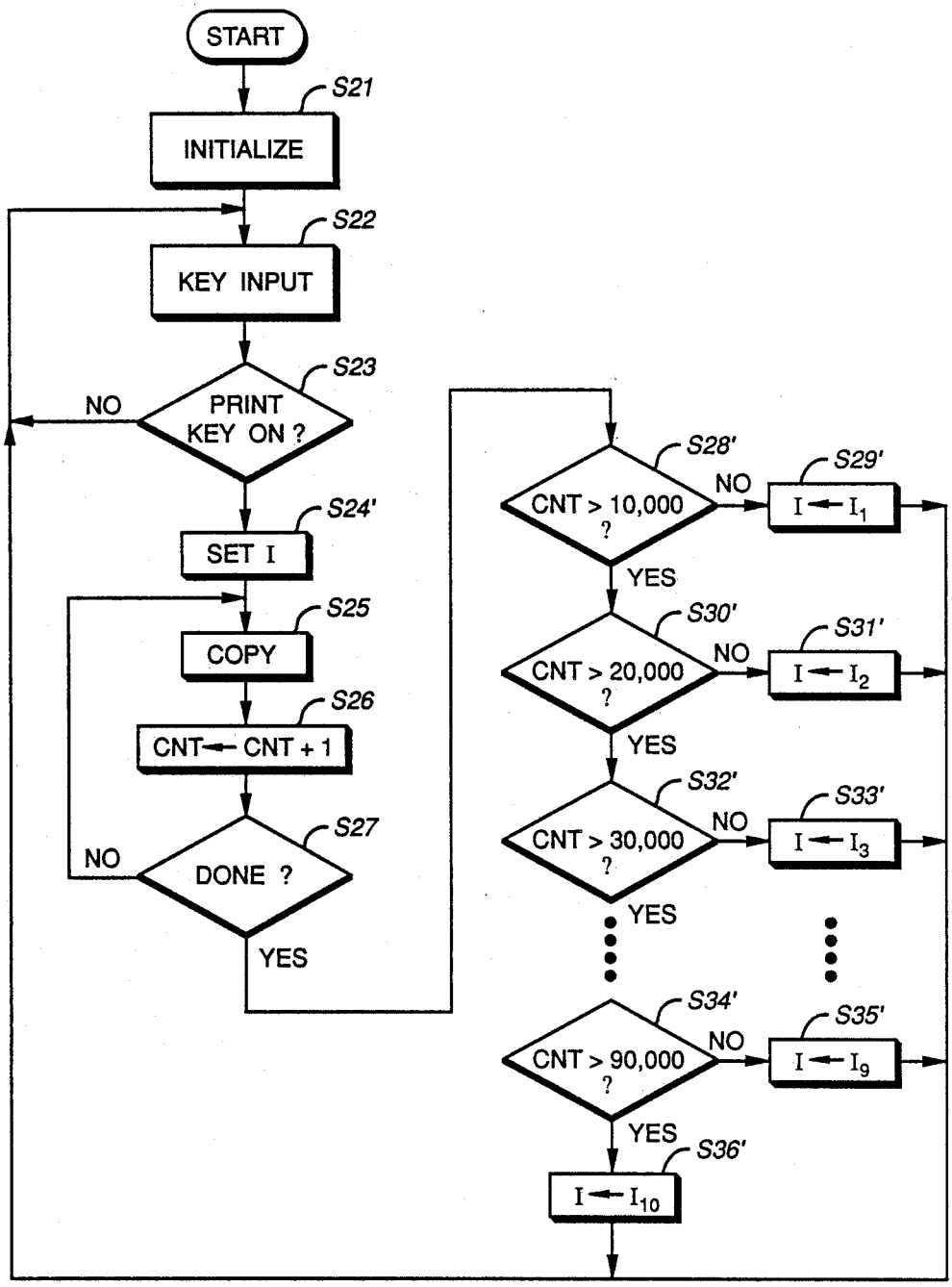
FIG. 24 is a portion of a flow chart for the operation of the copier shown in FIG. 23, In all these figures, components which are identical or can be structurally similar are indicated by the same numerals.

As shown in FIG. 24, the copier described above by way of FIG. 23 is operated functionally very similarly to the one described above by way of FIGS. 20 and 21. Thus, steps in the flow chart of FIG. 24 which are identical or at least similar to those in the flow chart of FIG. 21 are indicated by the same numerals. With reference therefore to both FIGS. 21 and 24, the CPU 30 of the copier of FIG. 23 serves to set the output level I for the principal charger 2 at Step S24'. After the desired number of copies has been produced, the content of the memory area CNT is examined and if the current cumulative copy count is less than 10,000 (NO in S28'), a certain predefined output level $I_1$ is stored in the memory area I of the RAM 33 (S29'), if it is between 10,000 and 20,000 (NO in S30'), another output level $I_2$ lower than $I_1$ is stored (S31'), if it is between 20,000 and 30,000 (NO in S32'), still another lower output level $I_3$ is stored (S33'), and so forth.

Figure 5:
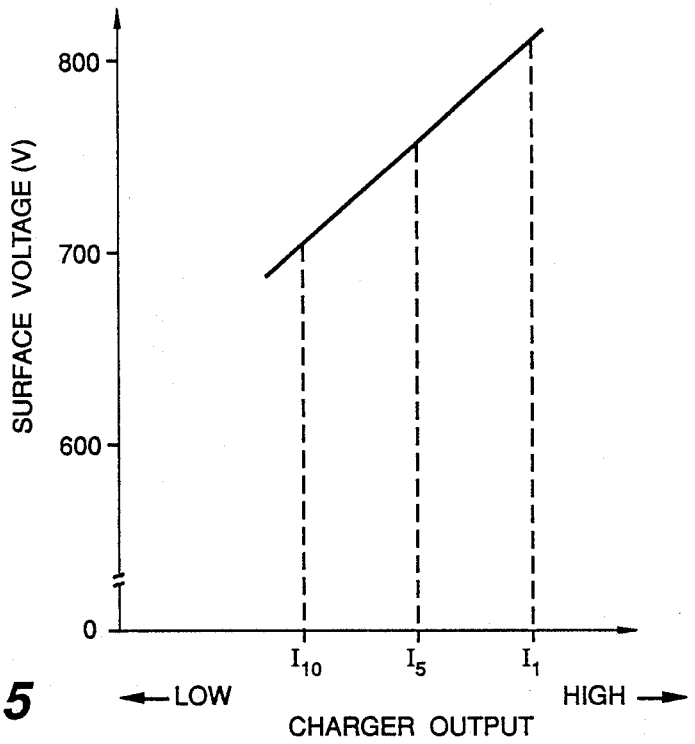
FIG. 5 is a graph showing the relationship between the output of a principal charger and the surface voltage of the photoreceptor.
Figure 6:
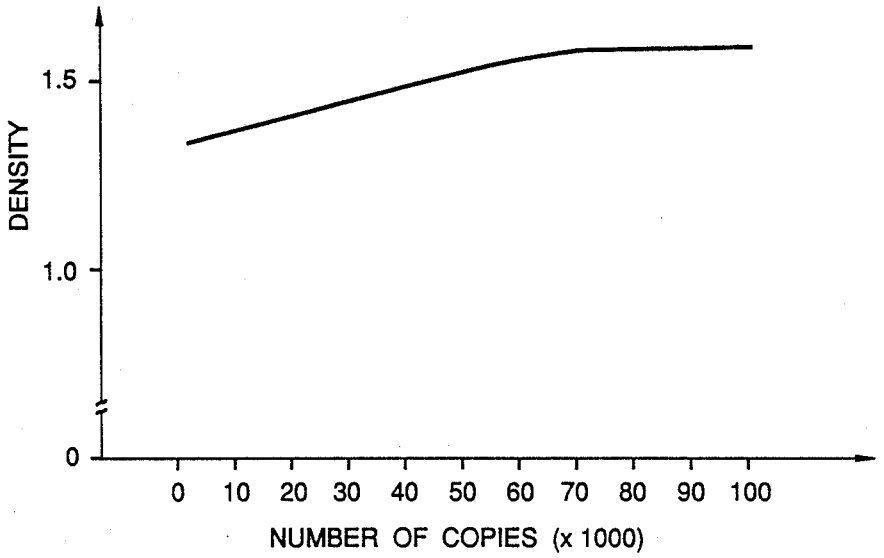
FIG. 6 (PRIOR ART)
FIG. 6 is a graph showing the change in copy density with the increase in the number of produced copies.

As shown in FIG. 5, the surface voltage of the photoreceptor drum 1 drops as the output level of the principal charger is reduced from $I_1$ to $I_{10}$. Since the attractive force on toner becomes weaker as the surface voltage of the photoreceptor drum is reduced, the copy density is also reduced. Thus, if the output level of the principal charger 2 is reduced step-wise after every 10,000 copies, the tendency of the copy density to increase with deterioration of the developing agent can be compensated. With the compensation effected as shown in FIG. 24, the results obtained were similar to the ones shown in FIG. 22. Alternatively, both the speed of development and the output level of the principal charger may be concurrently adjusted to compensate for the deterioration of developing agent.

The foregoing description of preferred embodiments of the invention has been presented for purposes of illustration and description. It is not intended to be exhaustive or to limit the invention to the precise forms disclosed, and many modifications and variations are possible in light of the above teaching. Such modifications and variations that may be apparent to a person skilled in the art are intended to be included within the scope of this invention.

What is claimed is:

1. An electrophotographic apparatus comprising
a photoreceptor having an image forming surface,
a timer for detecting duration of rest period of said photoreceptor, and
control means for step-wise reducing speed of development on said photoreceptor as the rest period of said photoreceptor detected by said timer becomes longer and step-wise increasing speed of development on said photoreceptor as number of copies processed on said photoreceptor increases, the speed of development being defined as relative speed of said image forming surface with respect to toner which brushes thereagainst in a developing device.

2. The apparatus of claim 1 wherein said speed of development is step-wise reduced and increased by said control means according to empirically determined relationship between image density and the number of processed copies and between image density and speed of development.

3. An electrophotographic apparatus comprising
a photoreceptor having an image forming surface,
a voltage detector for detecting surface voltage of said photoreceptor, and
control means for controlling speed of development of said photoreceptor depending on the surface voltage of said photoreceptor detected by said voltage detector, said speed of development being defined as relative speed of said image forming surface with respect to toner which brushes thereagainst in a developing device and reduced as said detected surface voltage increases.

4. The apparatus of claim 3 wherein said speed of development is changed by said control means according to empirically determined relationship between image density and surface voltage of said photoreceptor.

5. An electrophotographic apparatus using two-component developing agent to form a magnetic brush for development process, said apparatus comprising
a stirrer roller in a developing tank for stirring developing agent, and
control means for causing said stirrer roller to rotate at a faster rate during a predetermined time period after power is switched on and before development is started, said faster rate being faster than a normal rate therefor during development.

6. The apparatus of claim 5 wherein said predetermined time period starts immediately when power is switched on.

7. The apparatus of claim 5 wherein said predetermined time period starts when copying operation of said apparatus is started.

8. An electrophotographic apparatus using two-component developing agent with ferrite carrier to form a magnetic brush for development process, said apparatus comprising a photoreceptor having an image forming surface, a counter for outputting cumulative copy count by said apparatus, a principal charger for charging said photoreceptor, and control means for reducing speed of development of said photoreceptor and/or output level of said principal charger as said copy count outputted by said counter increases, said speed of development being defined as relative speed of said image forming surface with respect to toner which brushes thereagainst in a developing device.

9. The apparatus of claim 8 wherein speed of development on said photoreceptor and/or output level of said principal charger is reduced step-wise by said control means.

10. The apparatus of claim 8 wherein speed of development on said photoreceptor and/or output level of said principal charger is reduced according to empirically determined relationship between image density and copy count and/or between image density and output level of said principal charger.

* * * * *